United States Patent [19]

Winkler et al.

[11] Patent Number: 4,521,865

[45] Date of Patent: Jun. 4, 1985

[54] PROGRAMMABLE FUNCTION GENERATOR

[76] Inventors: Dean M. Winkler, 21 W. 86 St. 501, New York, N.Y. 10024; Jeffrey B. Curtis, 11434 Stewart La., Silver Spring, Md. 20904; Aaron J. Heller, 367 Congress St., Troy, N.Y. 12180

[21] Appl. No.: 383,147

[22] Filed: May 28, 1982

[51] Int. Cl.[3] ..... G06J 1/00

[52] U.S. Cl. ..... 364/608; 364/719

[58] Field of Search ..... 364/607, 608, 718, 719, 364/852, 851; 328/14, 114, 142

[56] References Cited

U.S. PATENT DOCUMENTS

| | | | |
|---|---|---|---|
| 3,529,180 | 9/1970 | Micheli | 307/265 |
| 3,535,555 | 10/1970 | Heimer | 307/251 |
| 3,548,318 | 12/1970 | Yorksie | 328/35 |
| 3,550,020 | 12/1970 | Gill et al. | 328/142 |
| 3,557,347 | 1/1971 | Robertson | 364/608 |
| 3,657,588 | 4/1972 | McRae | 313/113 |
| 3,662,160 | 5/1972 | Hoppes | 364/718 |
| 3,678,698 | 7/1972 | Gelbard et al. | 62/276 |
| 3,689,754 | 9/1972 | Le Febre | 364/608 |
| 3,697,780 | 10/1972 | Michael et al. | 307/235 |
| 3,727,037 | 4/1973 | Zorn | 364/608 |
| 3,740,539 | 6/1973 | Pace | 235/197 |
| 3,772,533 | 12/1973 | Bruckner et al. | 307/261 |
| 3,839,648 | 10/1974 | Pace | 307/229 |
| 3,889,198 | 6/1975 | Lighthall et al. | 328/59 |
| 3,916,327 | 10/1975 | Lampen et al. | 328/147 |
| 3,962,648 | 6/1976 | Watson, Jr. | 328/142 |
| 3,982,115 | 9/1976 | Traa | 235/197 |
| 4,064,423 | 12/1977 | Atkisson, Jr. | 364/718 |

*Primary Examiner*—Jerry Smith
*Assistant Examiner*—Allen MacDonald
*Attorney, Agent, or Firm*—James & Franklin

[57] ABSTRACT

A signal consisting of a sequence of contiguous line segments is generated to simulate a function. First programmable inputs define a first parameter (duration) corresponding to each of the line segments. Control signals are generated which are representative of each of the first parameters. A reference voltage representative of a second parameter (end point) corresponding to each of the line segments is generated and stored. The output signal comprises a portion representative of each of the line segments. Each portion is generated over a period determined by the control signal corresponding to the line segment which the portion represents, has an initial value determined by the stored reference voltage corresponding to the previous line segment, and a final value determined by the reference voltage corresponding to the line segment which the portion represents.

27 Claims, 11 Drawing Figures

FIG. 6A
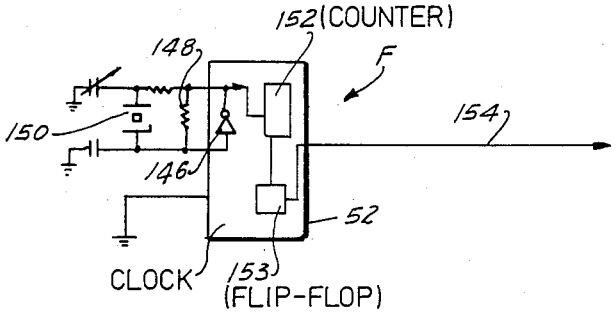
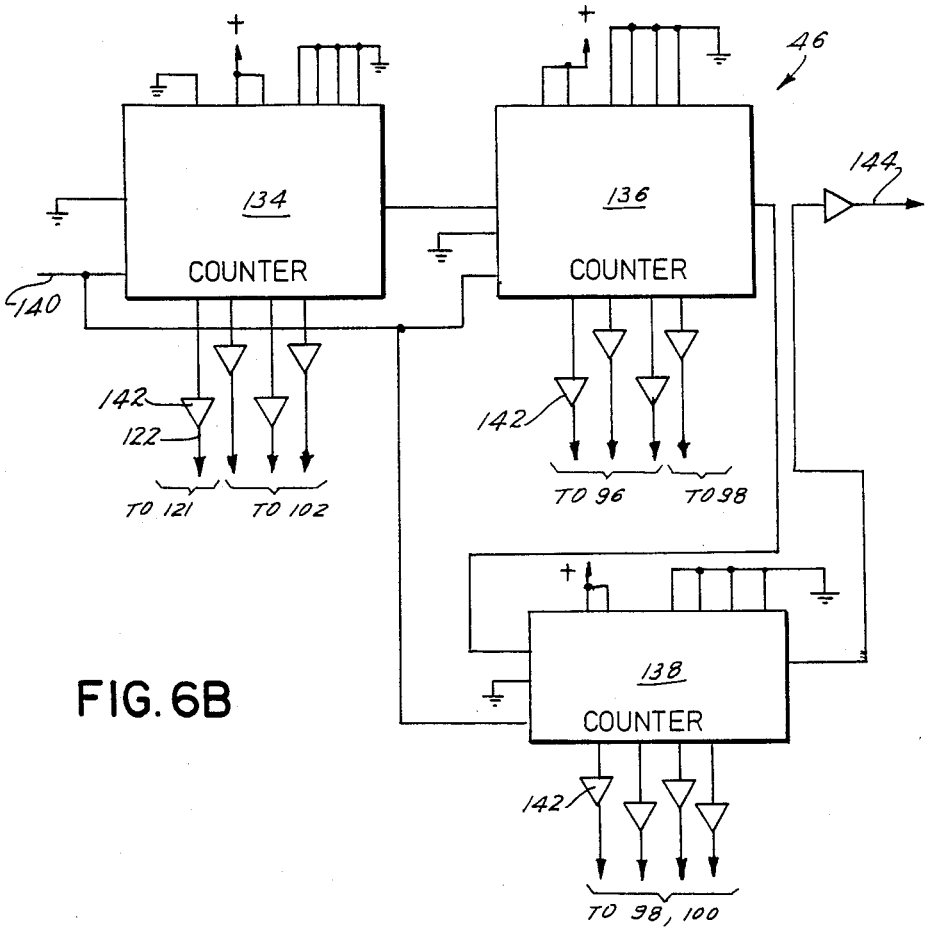
FIG. 6B

PROGRAMMABLE FUNCTION GENERATOR

BACKGROUND OF THE INVENTION

The present invention relates to function generators and, in particular, to a programmable function generator wherein signals defining the line segments simulating the function are generated in a simplified manner and the parameters for each segment are completely programmable.

A function or waveform generator is an electrical device which constructs or simulates an electrical waveform in response to one or more input signals. Such devices have found a variety of different applications in the electronics field. For instance, a function generator can be used to generate analog control waveforms and, thus, can be used as a central control mechanism for any voltage controlled device or system, such as a video or audio synthesizer. When used in conjunction with such a system, the device enables the operator to automatically implement a complex, predetermined series of events. For instance, the output of the function generator may be used to control an electron beam in a cathode ray tube or the like.

Many function generators can be partially or completely programmed to produce asymmetrical or other variant waveform outputs. Prior art examples of such programmable waveform generators include diode-type function generators, servo motor systems using cams and drums and digital memory systems.

Diode-type function generators are difficult to program and do not have independent adjustments at each programming point. Furthermore, while they are capable of responding to input signals relatively fast, they are sensitive to temperature variations. Servo motor systems are usually large and expensive, consuming a considerable amount of power while responding slowly to the input waveform. Digital systems also have numerous drawbacks. They are usually expensive because the input information must first be converted from analog to digital form, processed, and then reconverted to analog form. Thus, they require analog-to-digital and digital-to-analog converters, as well as a digital memory unit. Furthermore, this mode of operation often results in an output which varies in discrete steps. Thus, these types of devices tend to be overly complex and, because of discontinuities in the generated waveform, may not be suitable for certain applications.

One digital system is disclosed in U.S. Pat. No. 4,064,423 to Atkisson, Jr. In that patent, data for determining the characteristics of the line segments is stored in digital form in a programmable digital memory. The characteristics of each segment are read from the memory, in order, under the control of an address counter. The stored amplitude and time data is processed in a rate multiplier and a dividing counter to provide digital interpolations between the end points of the line segments. The multiplier has two portions. The first portion generates an output (base rate) which is utilized as a reference in resetting the system at the end of each line segment. The second section produces an output signal consisting of a number of pulses equal to the product of the base rate and the amplitude data.

The output of the second section is connected to the clock input of a counter which divides the signal from the rate multiplier by the time change information stored in the memory for each line segment. The output of the counter is divided into a series of digital pulses which are used to clock an up/down counter and determine the number of steps in each line segment. The stored information in the memory controls the counter and determines the amplitude of the segment. The output of the counter is a digital signal which drives a conventional digital-to-analog converter. The converter is supplied with a single reference signal and the output of the converter is a digitally-controlled percentage of the reference signal.

Since Atkisson utilizes a conventional single reference digital-to-analog converter, the digital control input thereto must be a complex signal containing the information relating to the duration, as well as the initial and termination points for each line segment. Because the control signal input to the converter must contain a large amount of information, the circuitry required to develop these complex digital control signals must be quite sophisticated.

The complexity of the Atkisson system and similar systems is a result of the type of voltage transition circuit which is used to generate the analog signal representative of the desired function. These devices utilize standard digital-to-analog converters which generate an analog signal which is a portion of a single fixed reference signal, the portion being determined by the digital control inputs. Thus, the digital control inputs must contain virtually all of the information concerning the line segment which the generated analog output represents.

It has been found that the necessary function can be generated in a far simpler and more eloquent manner and still permit the parameters of each of the line segments in the function to be independently programmed. This is possible due to the use of a unique voltage transition circuit which has first and second reference voltage inputs, an analog output and a digital control input. The first and second reference voltage inputs respectively receive voltages representative of the initial point and termination point of the line segment. The digital control signals represent the duration of the line segment and control the proportions of each of the separate input reference voltages which go to make up the analog output signal, at any particular time. Because the digital control signal inputs to the voltage transition circuit need not contain information concerning the end points of the line segment but only the duration thereof, the generation of the control signals is a relatively simple, straight-forward process, not requiring programmable electronic digital memories, analog-to-digital converters, rate multipliers, or complex counter systems.

It is, therefore, a prime object of the present invention to provide a programmable function generator wherein the parameters of the line segments are completely programmable.

It is another object of the present invention to provide a programmable function generator which is capable of cycling through a function at any desired repetition rate.

It is a further object of the present invention to provide a programmable function generator which utilizes a unique voltage transition circuit.

It is a further object of the present invention to provide a programmable function generator wherein the digital control signals for the voltage transition circuit are generated in a straight-forward, simple manner.

It is another object of the present invention to provide a programmable function generator wherein the object analog signal has improved resolution.

It is still another object of the present invention to provide a programmable function greater wherein the duration of each line segment may range from a fraction of a second to hours in length.

It is still a further object of the present invention to provide a programmable function generator which utilizes relatively simple components which interact reliably with a minimum of maintenance.

In accordance with the present invention, apparatus is provided for generating a signal representative of a function or the like consisting of a sequence of line segments. The apparatus comprises first programmable input means for defining a first parameter corresponding to each of the line segments. Second programmable input means generate a reference signal representative of a second parameter corresponding to each of the line segments. Means are provided for storing the generated reference voltages. Means are provided for generating control signals representative of each of the first parameters. Means are provided for generating an analog output signal comprising portions representative of each of the line segments. Each of the output signal portions is generated over a period determined by the control signal corresponding to the line segment which the portion represents, has an initial value determined by the stored reference voltage corresponding to the previous line segment, and a final value determined by the reference voltage for the line segment which the portion represents.

The first programmable input means preferably comprises a power source, a first variable resistance means corresponding to each of the line segments, and analog switch means having data input means for each of the line segments, a single data output means, and address signal input means. Each of the first resistance means is operably connected between the source and a different one of the input means of the analog switch means. The analog switch means serves to connect the appropriate resistance means to the data output means in accordance with an address signal corresponding to the line segment being generated. The output means of the analog switch means is connected by means of a time bus to the control signal generating means.

The first programmable input means also comprises means for generating address signals, connected to the analog switch means address input means and effective to cause the analog switch means to operably connect each of its input means to its output means, in a given sequence, such that each line segment is generated in turn. The address signal generating means preferably comprises a shift register and encoding means. The shift register drives the encoding means in accordance with a clock signal which, in turn, generates the necessary address signals for the analog switch means.

The second programmable input means preferably comprises a power source, a second variable resistance means corresponding to each of the line segments and a set of second analog switch means having data input means for each line segment, a data output means for each line segment, and address signal input means. Each of the second resistance means is operably connected between the source and a different one of the input means. Each of the output means is connected by means of a voltage bus to the output signal generating means. The second programmable input means is also controlled by the means for generating address signals. This means is connected to the address input means of each switch in the set of second analog switch means and is effective to cause the second analog switch means to operably select particular input means for connection with the output means.

The reference voltage storing means preferably comprises a sample and hold circuit. When actuated by a strobe signal, the sample and hold circuit stores the reference voltage relating to the termination point of the previous line segment. This stored value is utilized as the initial point for the next line segment.

The control signal generating means comprises clock means and counter means. The clock means indexes the counter means at a rate in accordance with a timing signal and the output of the first programmable input means from the time bus. The output of the counter means comprises the signals which control the voltage transition circuit. The clock means preferably comprises a controllable frequency divider.

More specifically, the clock means preferably comprises a voltage controlled oscillator. The oscillator comprises a counter, means for indexing the counter at a predetermined rate in accordance with the timing signal, means for generating a ramp signal in accordance with the output of the counter, and means for comparing the generated ramp signal with the output of the first programmable input means appearing on the time bus. The comparing means comprises a means for generating the pulse when the ramp signal exceeds the output of the first progammable input means appearing on the time bus. The counter means is reset in accordance with the pulse.

The output signal generating means comprises a voltage transition circuit having first and second analog inputs respectively connected to receive the outputs from the second programmable input means appearing on the appropriate voltage bus, and from the storage means. The voltage transition circuit generates an analog output signal representative of a proportional mixture of the reference voltage inputs, determined in accordance with the control signals.

The voltage transition circuit comprises analog switch means comprising first and second sets of inputs, operably connected to said first and second analog inputs, respectively, a set of outputs and control inputs. The control inputs are operably connected to receive the control signals such that the analog switch means causes selected inputs from the input sets to be connected to its output in accordance with the control signals. The analog signal generating means also comprises means for summing the analog switch means outputs to produce an analog output signal. The summing means preferably comprises a resistance ladder.

In the preferred embodiment disclosed herein, the first parameter relates to the duration of the line segment. The second parameter relates to an end point of the line segment, and, more particularly, to the termination point thereof. Since the duration and termination points of the line segment are completely programmable, and the initial point is determined by the termination point of the previous line segment, which is also programmable, the characteristics of each line segment may be completely programmed, giving the apparatus of the present invention a great deal of versatility, notwithstanding the fact that the apparatus is relatively simple in function and structure.

To the accomplishment of the above, and to such other objects as may hereinafter appear, the present invention relates to a programmable function signal generator, as disclosed in the following specification and recited in the annexed claims, taken together with the accompanying drawings, wherein like numerals refer to like parts, and in which:

FIG. 6A is a schematic diagram of the time base section of the programmable function generator of the present invention;

FIG. 6B is a schematic diagram of the transistion counter of the programmable function generator of the present invention;

Figures 8A, 8B:
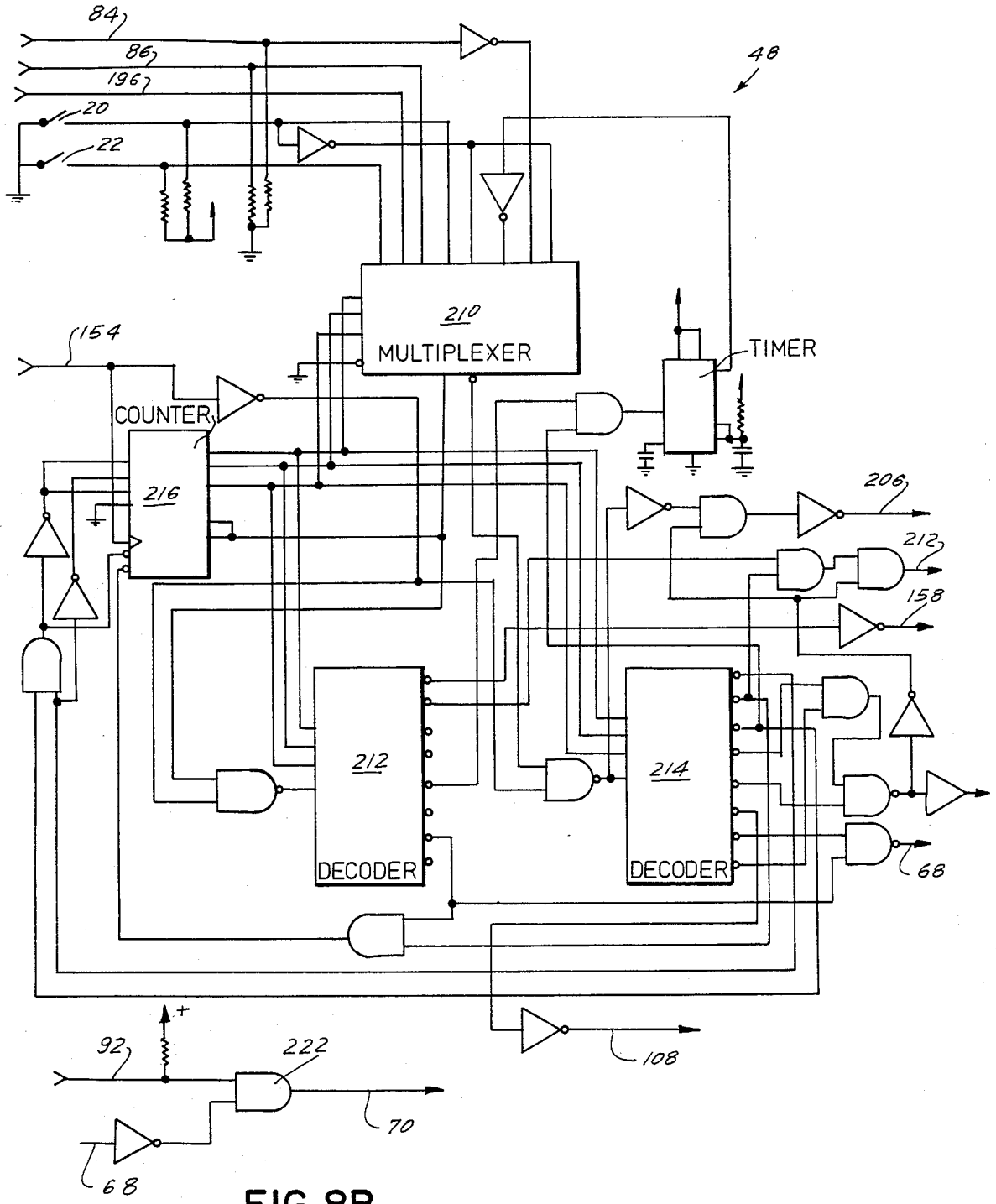
Figure 9:
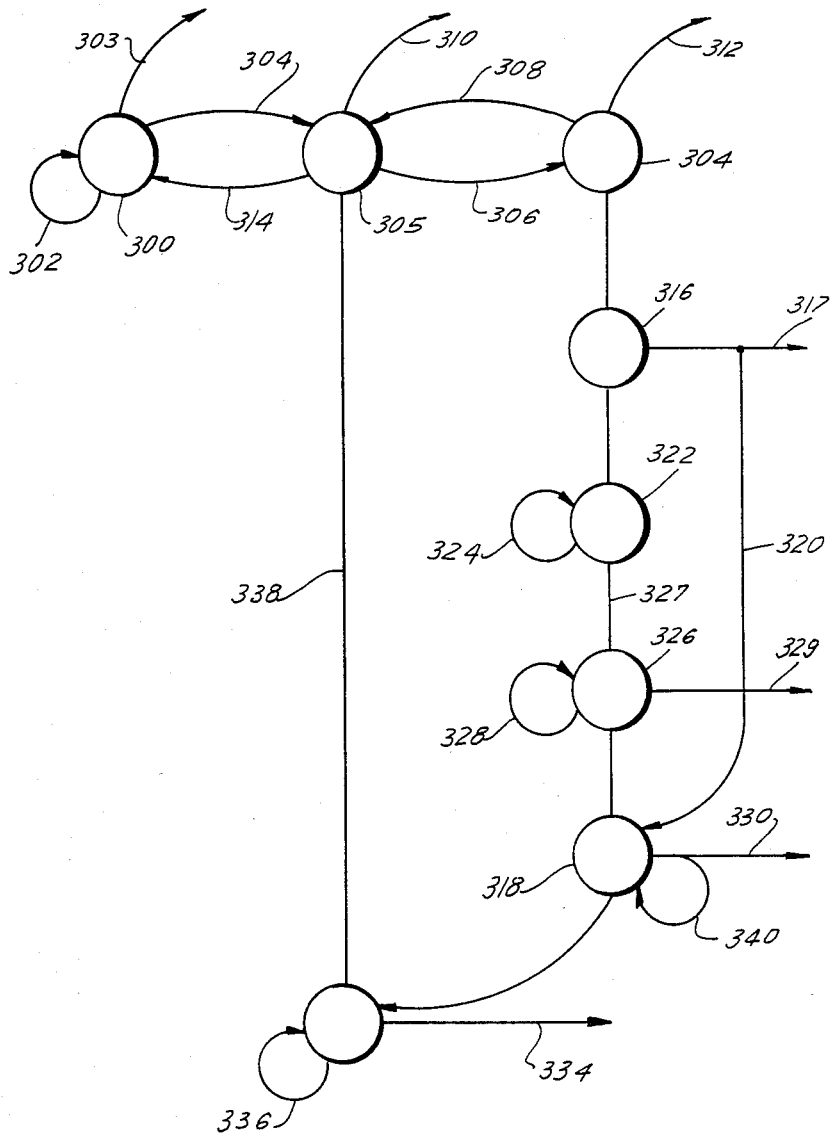

FIGS. 8A and 8B together comprise schematic diagram of the system controller of the programmable function generator of the present invention; and FIG. 9 is a state diagram of the system controller of the programmable function generator of the present invention.

Figure 1:
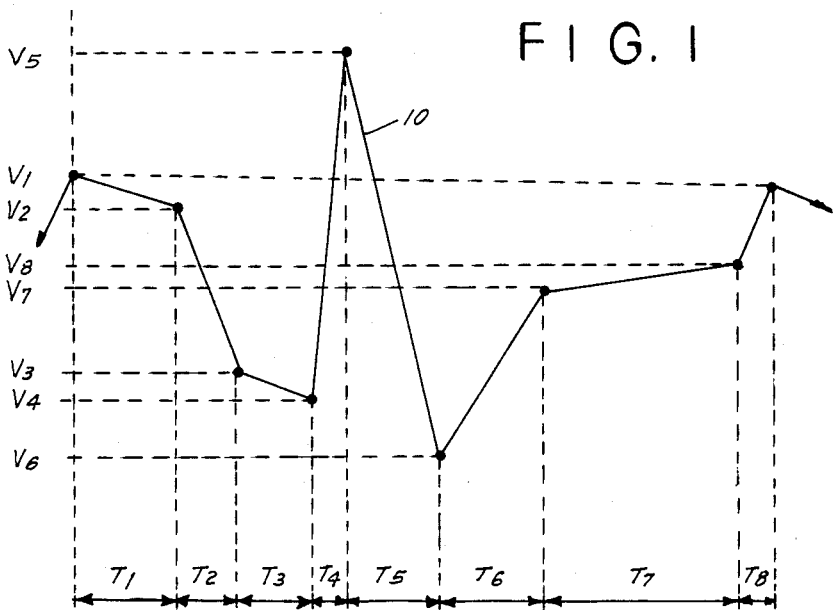
FIG. 1 is a graphical representation of a typical waveform which can be generated by the programmable function generator of the present invention.

In order to construct or simulate a general waveform, a function generator must break the waveform into a plurality of "pieces" or time slices, each of which can be accurately approximated by a linear transistion or ramp from one end point voltage level to another end point voltage level. This is illustrated in FIG. 1 which is a graphical representation of a typical function 10, where the abscissa represents time and the ordinate represents voltage. The single complete cycle of the function 10 is shown.

As illustrated, function 10 has been divided into eight "pieces" or time slices, designated as $T_1$–$T_8$, respectively. The voltage level at the initial point for each time slice T is designated as $V_1$–$V_8$, respectively. The termination point of each line segment is also the initial point for the next line segment in sequence, thus forming a continuous voltage waveform. Each line segment or ramp can be set to any arbitrary time length desired, and the end points thereof may also be set, thus completely defining the function. To accomplish this, there must be present, for each time slice, a duration control and a voltage control which, respectively, set the time between the transistion from one end point to the next of the segment and the voltage values corresponding to the end points of the segment.

Although the preferred embodiment of the present invention is described herein as being capable of dividing the function into eight separate time slices, as illustrated in FIG. 1, it should be understood that this number of time slices was selected for purposes of explanation only and that same should not be construed as a limitation on the present invention. In fact, the present invention lends itself easily to expansion to include additional time slices through a simple bus structure.

Figure 2:
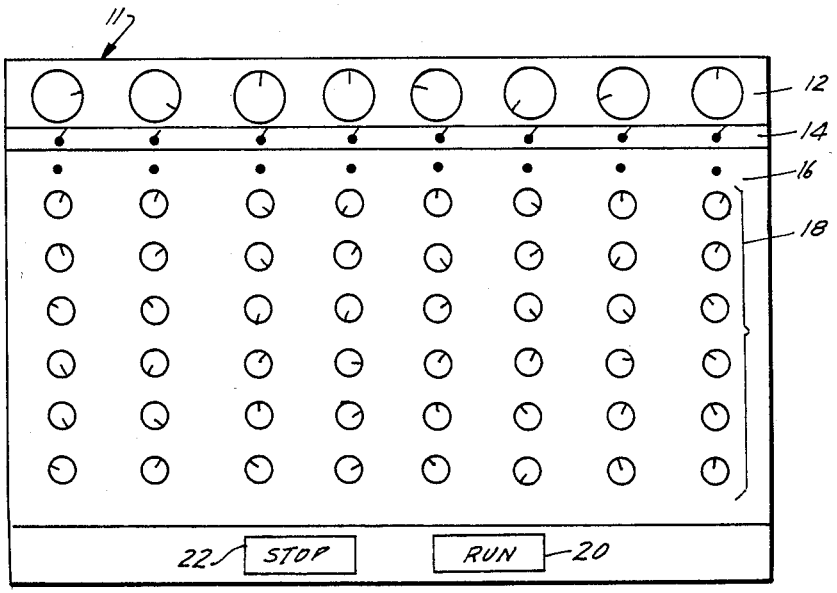
FIG. 2 is a plan view of the control panel of the present invention.

A preferred layout of the front control panel 11 of the device of the present invention is illustrated in FIG. 2. Shown are eight columns of controls, each of which corresponds to one of the time slices $T_1$–$T_8$, respectively. The top row consists of eight time duration controls 12, each of which defines the duration of the corresponding time slice T. Immediately below each of the time duration controls 12 is a "skip/run/hold" option switch 14 which permits the associated time slot to be skipped if it is not needed in a particular cycle, or causes the generator to freeze until released by the operator, upon finishing the transition associated with the column. Immediately below switches 14 is a row of light emitting diodes 16, or similar indicating devices, which tell the operator which of the time slices the device is currently generating. Below LEDs 16 is a $6\times8$ matrix of 48 voltage end point controls 18. The six rows of voltage end point controls 18 control six separate waveforms, which are completely independent in voltage, but are synchronized by time slice. The six independent waveforms are simultaneously available at the output of the device.

At the bottom of the panel are "run" and "stop" buttons 20 and 22, respectively. The run and stop buttons can stop or restart the generator anywhere in the cycle. The run bottom 20 also releases the generator after it has encountered a column which has the hold option in effect therein.

Figure 3:
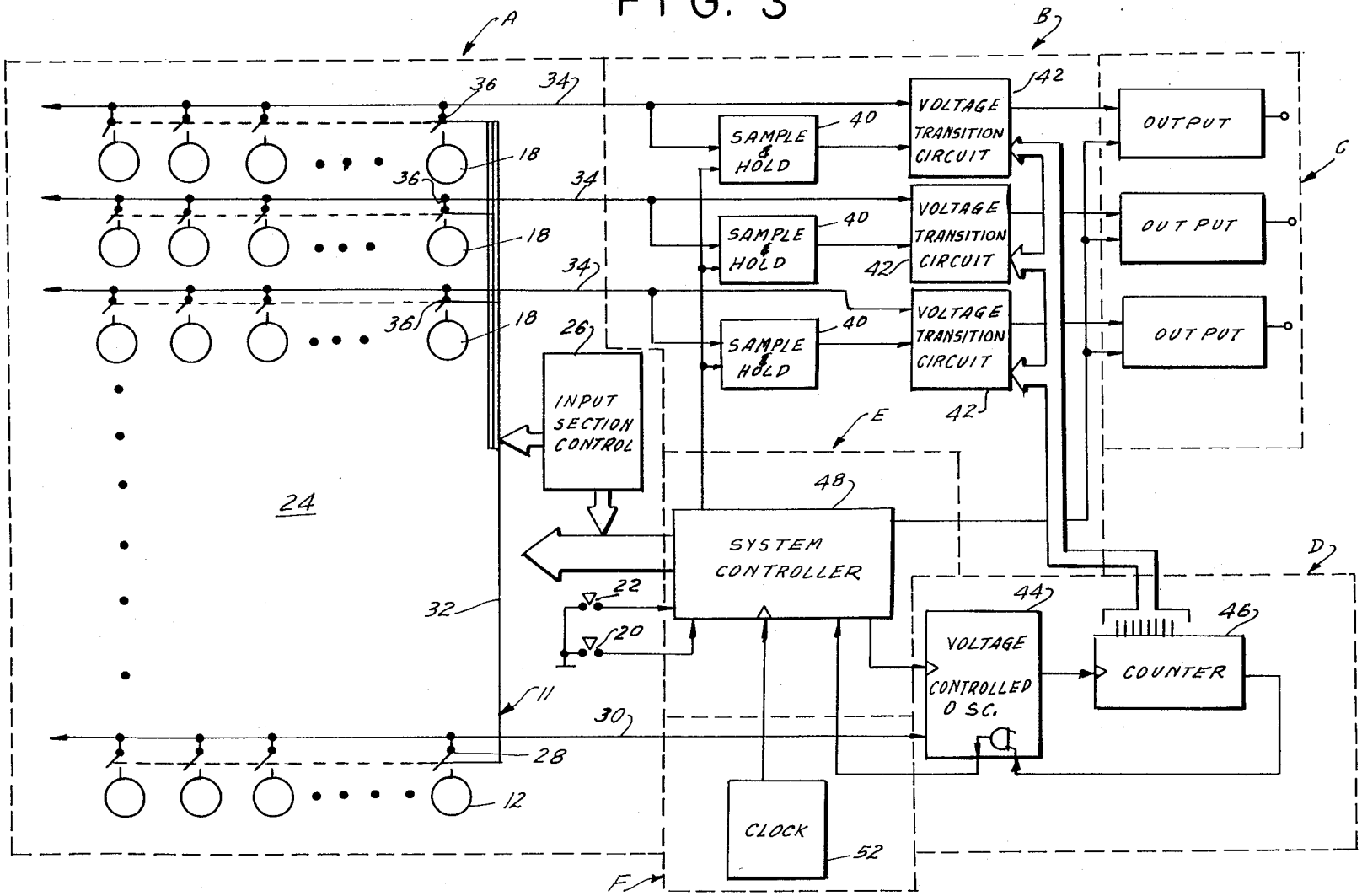
FIG. 3 is a block diagram of the programmable function generator of the present invention.

FIG. 3 shows a block diagram of the programmable function generator of the present invention. In general, the generator comprises an input section, generally designated A, which comprises a programmable portion 24 having front panel 11, only a portion of which is illustrated in this figure, and an input section control 26. The voltage output of input section A is applied to a voltage transition section, generally designated B which, in turn, is connected to an output section, generally designated C. Control signals for the voltage transition section B are generated in a control signal generator section, generally designated D, in accordance with duration signals from input section A. The overall operation of the entire device is controlled by a system control section, generally designated E, in accordance with clock signals generated by a time base section, generally designated F.

As indicated above, the programmable portion 24 of input section A comprises eight time duration controls 12. Each of the duration controls 12 is preferably a potentiometer and is individually connected to control signal generator section d through a different one of eight CMOS switches 28, which connect same to a time bus 30. Switches 28 are controlled in accordance with signals generated along bus 32 from input section control 26. Portion 24 also includes a plurality of rows (only three are shown) of voltage end point controls 18. Each control 18 in each row is connected with a voltage bus 34 associated with that row by a separate CMOS switch 36. Switches 36 are also controlled by signals generated by input section control 26. Controls 18 are also preferably potentiometers. The input section control 26 causes the appropriate voltage end point control 18 to be connected to the voltage bus associated therewith during a particular time slice.

Voltage buses 34 are connected as inputs to voltage transition section B. Voltage transition section B comprises a sample and hold circuit 40 and a voltage transition circuit 42 for each of the voltage buses 34. Each of the sample and hold circuits 40 serves to temporarily store the voltage value of the termination end point for the previous line segment. This value and the voltage which appears on voltage bus 34, which represents the termination point of the line segment being generated, are applied to the inputs of the voltage transition circuit 42, which provides a proportional mixture of the two voltages in accordance with a twelve bit digital control signal supplied thereto from control signal generator section D. The output of section B is then applied to output section C.

Control signal generator section D comprises a voltage controlled oscillator 44 which has as one of its inputs the time bus 30 which receives a voltage value determined by the setting of the appropriate duration control 12. The output of the voltage controlled oscillator 44 is fed to the clock input of a transition counter 46 which generates the twelve bit digital control signal to the voltage transition circuits 42.

The entire system is controlled by the system controller section E which comprises a modified Richards controller, of the type well known in the art, which is fed with a timing signal from time base section F, which comprises a clock 52. System controller 48 serves to synchronize the functions of the various components of the system.

Figure 4:
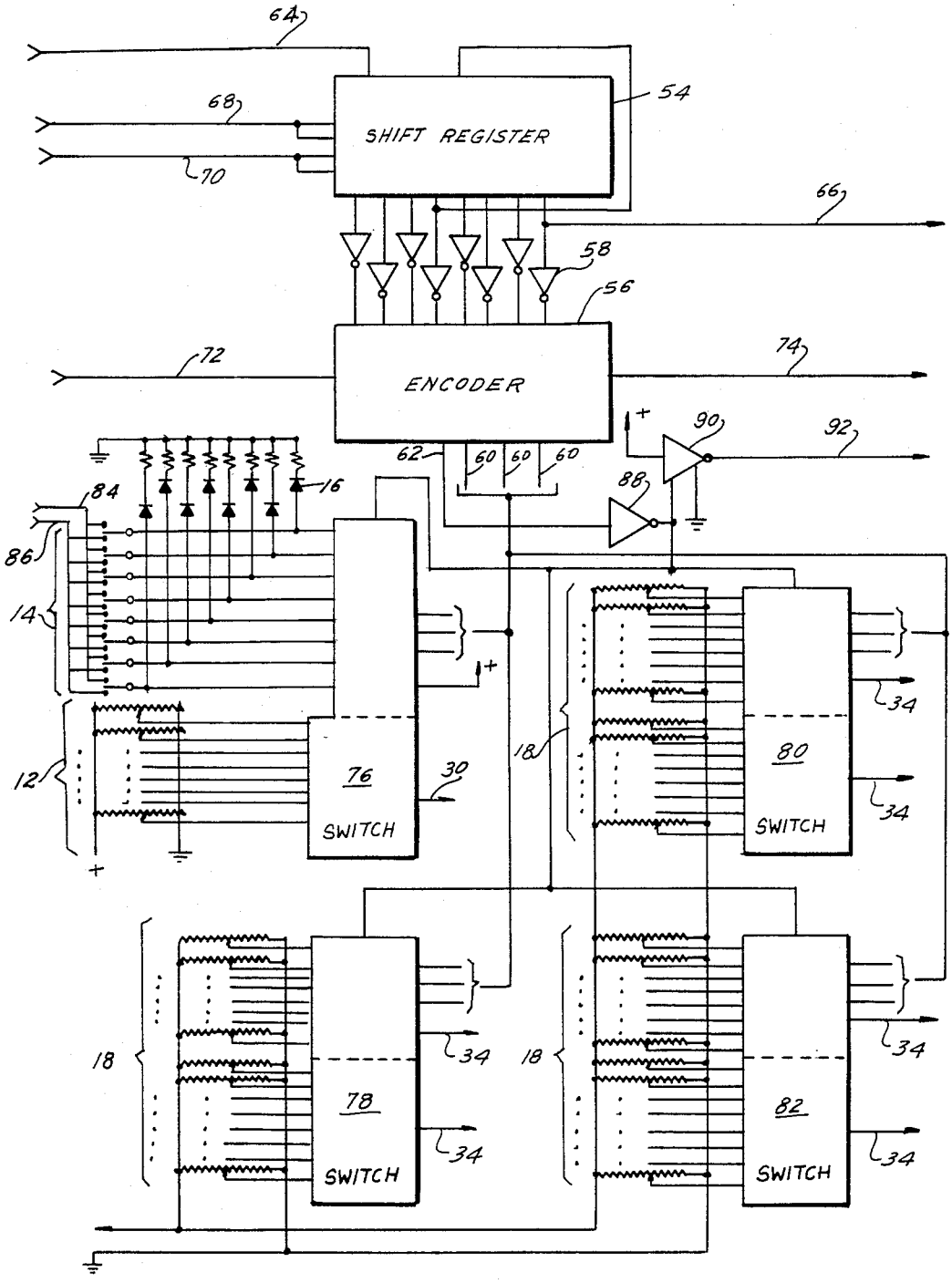
FIG. 4 is a schematic view of the input section of the programmable function generator of the present invention.

The input section A of the programmable function generator of the present invention is a bus-oriented system broken down into identical units which may be cascaded for infinite expansion. One of these units is illustrated in FIG. 4. As indicated above, each unit includes a programmable portion and an input section control. The programmable portion contains the analog switches which gate the appropriate voltages onto the voltage and time buses.

The function of the input section control is to keep track of the current time slice and feed appropriate address signals to the analog switch packages. This section consists of a chain of shift registers 54, down which a stream of ones are propagated, and a chain of priority encoders 56. Each chain consists of encoders which handle eight bits each and, therefore, eight time slices each. The priority encoders 56 are fed from the shift registers 54 through inverters 58. The chain of encoders 56 then finds and encodes the position of the leftmost one in the chain which corresponds to the leftmost zero in the shift register, because of the inverters 58. In this way, clearing the register returns the programmable portion to the first time slice.

Each priority encoder 56 puts out a three bit address (from zero to seven) on output lines 60, and a group select signal on line 62, indicating whether or not its own group of eight contains the current time slice. The group select signals drive a wired or "party-line" arrangement 92 such that when the shift register 54 runs all the zeros out of itself, no group select is enabled, the "party-line" is not grounded and the shift register is cleared by the system controller 48.

Shift register 54 may comprise a 4015 dual four-bit shift register or the like, where the two four-bit shift registers are chained to make a single eight-bit register. Register 54 receives the data chain input on line 64 from the previous unit (or from controller 48, if it is the first unit) and it generates a data chain output at line 66 for the next unit in sequence (or the controller 48, if it is the last unit). Shift register 54 also receives a clock signal from system controller 48 on line 68 and a reset signal from system controller 48 on line 70.

Priority encoder 56 is preferably a 4532 encoder or the like which, in addition to the inverted outputs from shift register 54, receives an enable chain input from the previous unit (or the controller 48, if it is the first unit) on input line 72 and generates an enable chain output to the next unit in succession (or the controller 48, if it is the last unit) on line 74.

The group select signal from output line 62 of encoder 56 and the time slice address lines 60, for each group, are fed to the programmable portion 24. CMOS switch 76 serves to connect a selected duration control to time bus 30. The six voltage buses 34 are connected by CMOS switches 78, 80 and 82 to the corresponding potentiometers 18 of the current time slice. Preferably, the CMOS switches are 4097 analog multiplexers which receive the three-bit address from outputs 60 of encoder 56 as well as the group select signal on output line 62. The latter is received at an inhibit input for each switch and opens all of the switches in the package if same is not selected. The address inputs are available directly from encoder 56. The inhibit inputs are available from encoder 56 through inverter 88. Since there are two 8-to-1 analog switches per package, only four packages are needed for each unit when there are six voltage buses.

Analog switch 76 is also provided with a portion thereof connected to skip/run/hold switches 14. When a time slice is active, analog switch 76 supplies high logic level to the center wiper of the corresponding skip/run/hold switch 14. If the switch 14 is thrown either way, the skip bus 84, or the hold bus 86, will be brought to logic "1" level, which will trigger action in the system controller 48. Situated between skip/run/-hold switches 14 and the inputs to analog switch 76 are connections to eight light-emitting diodes 16 which are connected through resistors of preferably 92052 to ground, and serve to indicate the currently selected time slice on the front panel 11 of the input section A.

The group select output generated by encoder 56 appears on line 62 and is transferred through an inverter buffer 88 before being fed to the inhibit inputs of the analog switches 78, 80 and 82. The output of inverter buffer 88 is used as the inhibit input for a tri-state inverter buffer 90, such as 4502 or the like, which generates an output signal on line 92 to the other units and the system controller 48, such that only a single unit is operative at any one time.

Figure 5:
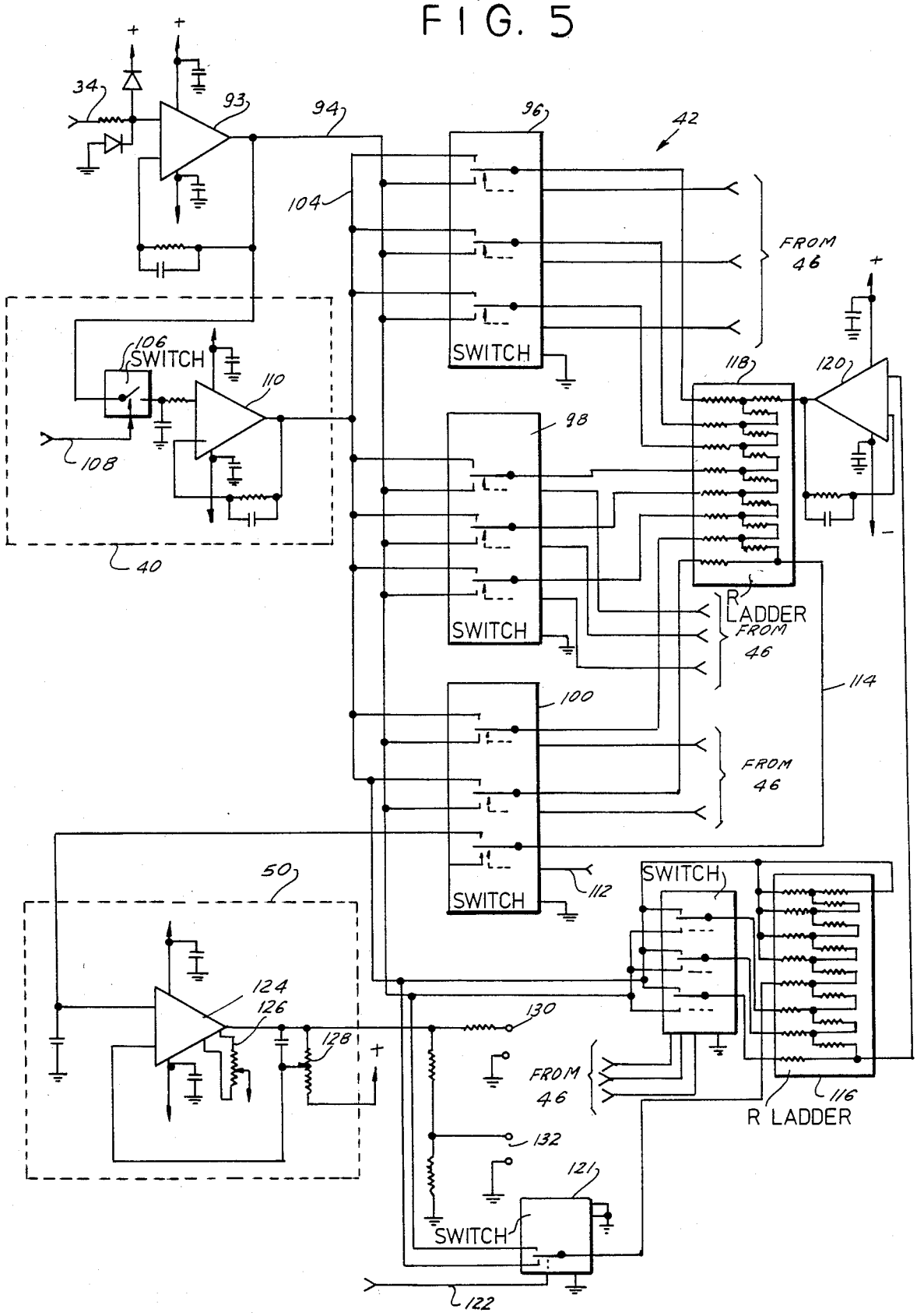
FIG. 5 is a schematic view of a sample and hold circuit, a voltage transition circuit, and an output circuit of the programmable function generator of the present invention.

FIG. 5 shows the structure of a sample and hold circuit 40, a voltage transition circuit 42, and an output circuit 50. The heart of the function generator of the present invention is the voltage transition circuit 42 which provides a proportional mixture of two input reference voltages. The proportion variable is a twelve-bit digital control signal generated by counter 46.

Voltage transition circuit 42 is basically a digital-to-analog converter which employs a R-2R resistor ladder network and CMOS switches. However, unlike conventional digital-to-analog converters, voltage transition circuit 42 has two reference voltage inputs, instead of one, as is normal in conventional digital-to-analog converters. The digital control signal input dictates how much of each of the input reference voltages is to form the output analog signal. This control signal input, which is fed from the transition counter 46, cycles through all of the binary weighted codes from all zeros to all ones, forming a smooth linear transition from the first reference voltage to the second reference voltage. The speed of the transition is controlled by the rate at which counter 46 is clocked. The circuit is unique in that the two references have no restrictions on their relative or absolute voltage valves.

As indicated above, the two reference voltage inputs which feed the transition circuit 42 represent the end point voltages of the line segment of the current time slice. The reference voltage input which represents the termination point of the line segment is fed from the voltage bus 34 onto which different voltage potentiometers 18 are switched, depending on the current time slice, under the control of the input section control 26. The other reference voltage input is fed from a sample and hold circuit 40, which takes advantage of the fact that the segments in the waveform are contiguous, that is, the origination voltage value of each segment is equal to the destination voltage value of the previous segment. Therefore, if the sample and hold circuit 40 is used to temporarily store the voltage at the end of the last time slice, that stored voltage may be advantageously used as the first voltage reference input to the transition circuit 42. The sample and hold circuits 42 are strobed by a signal from the system controller 48 at the appropriate point at the end of each time slice.

Thus, for each independent output of the generator, there must be a voltage transition circuit 42, a sample and hold circuit 40 and an output circuit 50. To expand the generator vertically, all that must be added are additional sets of these circuits and the appropriate extra analog switches in the input section of the device.

The voltage bus 34, which originates in input section A, passes through an input buffer 93, such as a 3140 amplifier or the like, which directly feeds a bus 94. Bus 94 supplies one set of inputs to four triple, double-throw 4053 analog switches 96, 98, 100 and 102. The other set of inputs to analog switches 96, 98, 100 and 102 is connected to a bus 104 which is fed the output of sample and hold circuit 40.

Sample and hold circuit 40 receives its input from the output of buffer amplifier 93 which is applied to the input of a 4066 CMOS switch 106. Switch 106 is closed in accordance with a strobe signal generated by system controller 48 which appears on line 108. Sample and hold circuit 40 comprises a 3140 buffer amplifier 110, similar to amplifier 93.

Each of the CMOS switches 96, 98 and 102 receives three control inputs from transition counter 46, which determine the state thereof. CMOS switch 100 receives two inputs from transition counter 46 and a single input, on line 112, from systems controller 48. The signal applied to control input 112 of CMOS switch 100 serves to connect the analog output of transition circuit 42, which appears on line 114, to the input of output circuit 50.

The data outputs from CMOS switch 102 are applied to the inputs of a first R-2R ladder 116. The output of ladder 116 is connected to the input of a second ladder 118 through an inter-ladder buffer which consists of a 1456 amplifier 120, or the like. The data outputs of CMOS switches 96, 98 and 100 are applied to the individual inputs of second R-2R resistance ladder 118.

One of the inputs for resistance ladder 116 is fed from the output of a 4053 electronic switch 121 which is controlled by a control signal appearing on line 122, also generated from transition counter 46. The data inputs to switch 121 are the respective reference voltages appearing on buses 94 and 104.

When the appropriate output strobe signal appears on input control line 112 for CMOS switch 100, the output of the voltage transition circuit, which appears on line 114, is connected to the input of output circuit 50. Output circuit 50 comprises a 1456 amplifier 124 with an off-set null adjustment 126. The output of amplifier 124 passes through a gain control potentiometer 128 and then is applied to a high level output node 130 and a low level output node 132. Output circuit 50 is essentially a sample and hold circuit which resamples the output of the voltage transition circuit 42 to remove gliches in the waveform caused by mismatches in the CMOS switches turn-on and turn-off times, which show up when the transition counter 46 is advanced.

As indicated above, the control signal inputs to CMOS switches 96, 98, 100 and 102 are generated by transition counter 46, the structure of which is illustrated in FIG. 6B. The transition counter 46 is a straight-forward twelve bit synchronous counter used to step the voltage transition circuits 42 along the line between the reference voltage inputs. The twelve-bit output of the counter is fed to all the transition circuits as the proportional variable or mixture variable and dictates how much of each reference voltage input is added to form the analog output. When the counter is at zero, the output voltage is taken totally from the sample and hold circuit 40. When the counter is at the maximum count, the output is taken from the voltage bus 34. Anywhere in between is a proportional mixture of the two reference voltages.

The transition counter 46 comprises three 4029 four-bit counters 134, 136 and 138. Each of the counters receives a clock signal at line 140 which is the output of the voltage controlled oscillator 44. The outputs of each of the counters 134, 136 and 138 are driven by buffers 142 so as to form the control signals which are then applied to the CMOS switches 96, 98, 100 and 102 and switch 121.

The transition counter 46 is advanced by a clock signal from the voltage controlled oscillator 44 which appears on line 140. The voltage controlled oscillator 44 is under the control of the systems controller 48 and the time bus 30. The synchronous carry output of the transition counter 46, which appears on line 144, is fed back to the voltage controlled oscillator 44 and, thereafter, to the system controller 48. This carry output signifies the end of the current time slice and is the key signal which starts the sequence of events in the system controller 48, causing the generator to advance the next time slice. Transition counter 46 is never reset, nor loaded, but is allowed to overflow back to zero after it reaches its maximum count.

Shown in FIG. 6A is the time base section F of the function generator. All timing signals for the system are derived from this clock 52 which serves as the input to the system controller 48 which, in turn, regulates the control signal generator D and, thus, sets the ramp speed for each line segment. The clock 52 is basically an inverter 146 with a 10 megohm resistor 148 connected in parallel therewith so as to bias inverter 146 in the middle of its linear range, making it a high gain amplifier, as is commonly done with this type of CMOS device. In addition, a crystal network 150 is also connected in parallel with inverter 146. The output of inverter 146 is fed to a chain of divide-by-two counters 152. The inverter and fourteen stages of divide-by-two counters are commercially available on a 4060 IC package which includes a fourteen stage ripple counter with taps available, operating as a divide-by-$2^9$ counter. This IC package is used in the present invention with a common 3.58 mHz crystal 150 and the ninth tap on the divider has been selected to give a 14 kHz master clock frequency at output 154. The duty cycle of this clock output will be 50% due to its being divided by two, by a flip-flop 153.

Figure 7:
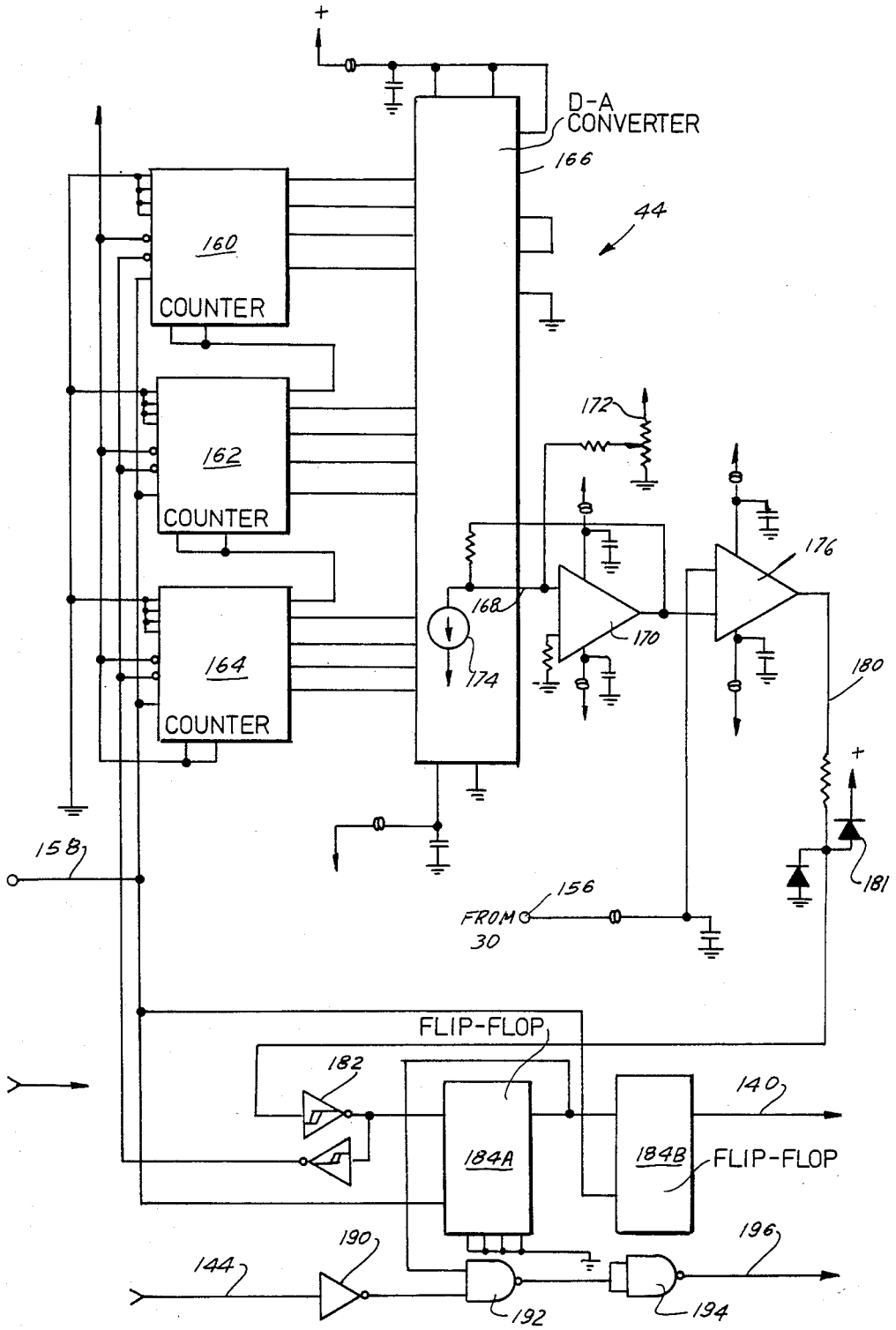
FIG. 7 is a schematic diagram of the voltage controlled oscillator of the programmable function generator of the present invention.

As mentioned previously, the voltage controlled oscillator 44 provides a clock signal input for transition counter 46 in accordance with the timing signal generated by system controller 48 which, in turn, is based on the output of clock 52. The clock signal input for the transition counter 46 will vary the frequency of counter 46 inversely proportionally with the setting of the time control 12 for the current time slice. In reality, this section is not an oscillator at all, but is a controllable frequency divider, as shown in FIG. 7.

The time duration control 12 for the current time slice is switched by the appropriate CMOS switch onto the time bus 30 by the input section control 26. The time bus 30 is connected to the voltage controlled oscillator 44 at line 156 to control the speed of the ramp. The voltage on the time bus 30 is proportional to the desired period of the ramp—not the frequency of the transition counter 46. The higher the voltage on the time bus 30, the slower the transition counter 46 will be clocked, the slower the ramp should be produced.

The voltage controlled oscillator is fed a clock signal on line 158 from controller 48. The clock signal which appears on line 158 is based on the output of clock 52. The clock signal which is applied to line 158 causes a twelve bit counter composed of three synchronous, four-bit counters, number 74C163, designated 160, 162 and 164, to increment. The value in the counter is constantly available to a conventional digital-to-analog converter 166 such as AD563 or the like.

D-A converter 166 generates a ramp or sawtooth wave at output line 168. This signal is generated to the input of a current/voltage converter 170 such as an IC1456. As offset adjustment 172 is provided which is also connected to line 168. Numeral 174 is a symbol for a "current source", embedded within a digital-to-analog converter, which is how digital-to-analog converter output is modeled. At digital-to-analog full scale input code, source generates −2mA current (flows into chip).

The output of converter 170 is applied to the negative input of an IC1456 comparator 176 which receives its positive input from line 156, which is connected to time bus 30. The ramp is compared in comparator 176 to the time bus voltage on line 30. When the ramp voltage exceeds the bus voltage, a pulse is produced on line 180 which is used to reset transition counter 46 on the next clock pulse. The pulse on line 180 passes through a diode clipper circuit 181 and is shaped by a Schmidt trigger gate 182, delayed by a pair of D-type flip-flops 184A and B, such as a 4013 or the like, and then applied, via line 140, to the transition counter's clock input. The lower the voltage on time bus 30, the sooner the generated ramp reaches and exceeds it, the closer the reset pulses are, and the faster the output pulse rate.

The voltage controlled oscillator section of the waveform generator of the present invention is also responsible for producing a "Max count" signal for system controller 48. This signal tells the controller when the next clock input pulse to voltage controlled oscillator 44 will cause transition counter 46 to overflow. It is a combination of the transistion counter carry output signal and the voltage controlled oscillator reset signal. The carry output from the transition counter 46 is received on line 144, fed through an inverting amplifier 190, and to one of the inputs of a 4011 NAND gate 192. The other input to NAND gate 192 is the output of the first of the D-type flip-flops 184. The output of NAND gate 192 is fed to both inputs of a second NAND gate 194 which, in turn, generates the "Max count" signal to the controller 48 on line 196.

The counters 160, 162 and 164 in the voltage controlled oscillator are synchronous, which guarantees that the voltage controlled oscillator clock signal on line 140 will have a finite pulse width, nearly equal to that of the clock 52. This, then, guarantees that the "Max count" signal on line 196 will have a good pulse width and will be present until the next clock edge.

System controller 48 is shown in FIGS. 8A and 8B. The function of the system controller 48 is to control the operation of other sections of the generator and provide the proper timing signals for them. The controller is a classic Richards controller with a slight modification. Since Richards controllers are well known in the art, the structure thereof will not be considered in detail herein.

The modification which has been made to the Richards controller of the present invention relates to the fact that a clock signal is fed to the command decoders 212 and 214 which inhibits them and, thus, inhibits all outputs, when the clock signal is high. This modification was required because when that clock signal goes high, the state of the controller, which changes, may cause invalid states to appear momentarily decoded. Also, the inputs from the previous state will still be on the decoder outputs until the state change propagates therethrough. Since many of the system controller outputs drive edge-triggered devices, momentarily invalid signals cannot be tolerated. Therefore, all controller oututs are inhibited by the clock when it is high. The state change will have propagated through the circuit by the time the clock goes low. All outputs are emitted simultaneously with the negative edge of the clock.

The controller 48 has a plurality of inputs and outputs. The inputs are STOP from stop button 22, RUN from go button 20, "Max count" on line 196 from the voltage controlled oscillator 44, and skip and hold on lines 84 and 86, respectively, both from the programmable portion 24 of the input section A. The outputs are the clock signal for the voltage controlled oscillator appearing at line 158, the strobe signal for sample and hold circuits 40, which appears on line 108, and a strobe signal for the output circuits 50, which appears on line 112. In addition, a RUN indicator signal appears on line 206, a clock signal, which drives the first unit of the input section control 26, appears on line 68, and a clock signal which drives the voltage controlled oscillator appears at line 158.

The inputs from lines 20, 22, 196, 86 and 84 are connected to an input multiplexer 210 such as 74C151 or the like. The outputs of multiplexer 210 are connected to the inputs of an input high decoder 212 and an input low decoder 214, both of which are 74C42 binary coded decimal-to-decimal decoders or the like. Decoders 212 and 214 are also fed from a state counter 216, such as a 74C163 synchronous counter or the like, which receives at its clock input the output of clock 52 from line 154. The outputs of decoders 212 and 214 pass through a network of inverters and gates such that the necessary outputs are formed.

FIG. 9 is a state diagram for controller 48. The controller does the debouncing of the RUN and STOP buttons 20 and 22. When in the stopped state, the controller sits in a state represented by circle 300, as indicated by arrow 302, until the run button 20 is depressed. In this state, the output circuit strobe signal (on line 112) is generated, as indicated by arrow 303. When the run button is depressed, the controller moves to a second state, indicated by circle 305, as shown by arrow 304, and cycles between the state of circle 305 and the state of circle 304, as indicated by arrows 306 and 308. In the state represented by circle 305, the clock signal to the voltage controlled oscillator is generated, as indicated by line 310, causing the transition counter 46 to move along at a rate determined by this clock signal. When in the state designated by circle 304, the output sample and hold circuit 50 is also strobed, as indicated by arrow 312, to hold the new output voltage from the voltage transition circuit 42. If the stop button 22 is pressed, when the controller gets to the state designated by circle 305, it will jump to circle 300, as indicated by arrow 314 and will stay there until the run button 20 is again depressed.

While running in the loop between circles 304 and 305, as designated by arrows 306 and 308, eventually, "max count" will go high as a result of reaching the end of the current time slice. At this point, the controller jumps to a state designated by circle 316. When in the state represented by circle 316, the controller examines the hold bus 86. If the hold switch is set, then the operation of the controller will stop until the run button 20 is depressed. If hold is not in effect, then the controller will emit a trigger signal, as designated by arrow 317, and will jump to a state designated by circle 318, as shown by arrow 320, bypassing the hold processing. The trigger will start a timer (the timer is unnumbered) in the controller 48 which will hold the system in state 318, as shown by arrow 340, for preferably about 1 millisecond. After the timed interval, the timer will reset and the system will step to state 332, as described below for the hold processing case. While in state 318, sample and hold circuit 40 is strobed as described below and as indicated by line 330.

If hold is in effect, the next state will be that which is designated by circle 322 and the controller will remain in this state, as indicated by arrow 324, until the run button is free. The operator may have been leaning on the run button and, therefore, it is required that a leading edge be present or else several holds in a row might be released with one operation of run, if the times are set to be very short. When the run button is clear, the controller moves to the state designated by circle 326 and, as shown by arrow 327, will remain in this state, as shown by arrow 328, until the run button is depressed. In state 326, output circuit strobe signals are emitted, as designated by arrow 329. Once the run button is depressed, the controller moves to state 318 where the sample and hold circuits 40 are strobed, as indicated by line 330. When a signal is generated along line 330, the sample and hold circuit 40 is strobed to pick up its new origination voltage. If the timer which was started in state 316 is still active, state 318 will wait as indicated by arrow 340, and will continue to strobe sample and hold circuit 40, as indicated by line 330. When the timer interval elapses, state 318 steps to state 332 where the input section is advanced to the next time slice, as indicated by line 334. If "skip" is set for the new time slice, the controller stays in state 332 and emits the signal on line 334 repeatedly, as indicated by arrow 336. This occurs until the "skip" bus is low as a result of a landing on a time slice without a "skip" in effect, at which time the controller goes back to state 305, as indicated by line 338.

The only other item in the system controller 48, besides the Richards controller, is the reset section, shown at FIG. 8B. This section takes the "party line" output from line 92 (see FIG. 4) and loops it back down the reset bus 70 to shift register 54 (FIG. 4), but gated in an AND gate 222 with the inversion of the signal which appears on output 68 of the Richards controller, so that the shift register 54 reset will by synchronous, and not triggered by gliches or by a race of one unit dropping the "party line" bus, and another unit picking it up.

In practice, it has been discovered that a perfectly linear ramp is not always the ideal control waveform. This is especially true when the waveform is directly controlling motion on a CRT screen or the like. It, therefore, may be advantageous to add a capacitive dampening circuit to the output buffer of the voltage transistion circuit 42. This allows the operator to round the top and bottom of the control ramp as much as desired, producing a "swooping" motion on the screen.

It will now be appreciated that the present invention relates to a programmable function generator which permits complete programming of the parameters of the waveform which is simulated in a relatively simple, straight-forward manner without the necessity for digital memory capacity or complex control signal generating techniques and structure. This is accomplished through the use of a unique voltage transition circuit which has two reference voltage inputs representing the voltage value of the initial point and the voltage value of the termination point of a line segment. The voltage transition circuit generates an analog output which is a proportional mixture of the two input reference voltages determined in accordance with control signals which represent the desired duration of the line segment.

Because the control signals to the voltage transition ciruit only contain information concerning the duration of the line segment, it is possible to generate these control signals in a simple straight-forward manner. A transition counter driven by a voltage controlled oscillator generates a 12-bit digital control signal to the voltage transition circuit so as to determine the duration of the line segment. The operation of the entire system is under the control of a systems controller which is basically a Richards controller with a slight modification to prevent triggering of the controlled items by gliches caused by changes in state of the controller.

Only a single preferred embodiment of the present invention has been disclosed herein for purposes of illustration. However, it is obvious that many modifications and variations could be made thereto. It is intended to cover all of these variations and modifications which fall within the scope of the present invention, as set forth in the following claims:

We claim:

1. Apparatus for generating a signal representative of a function or the like comprising a sequence of line segments, the apparatus comprising:

first programmable input means for defining a first parameter corresponding to each of said line segments;

second programmable input means for generating a reference voltage representative of a second parameter corresponding to each of said line segments;

means connected to said second programmable input means for storing said reference voltages;

means connected to said first programmable input means for generating control signals representative of each of said first parameters; and means connected to said second programmable input means, said means for generating control signals, and said means for storing said reference voltages for generating an output signal comprising portions representative of each of said line segments, each of said portions being generated over a period determined by the control signal corresponding to the line segment which said portion represents and having an initial value determined by the stored reference voltage corresponding to the line segment previous to the line segment which said portion represents, and a final value determined by the reference voltage for the line segment which the portion represents, wherein said first programmable input means comprises:

a power source;

first variable resistance means corresponding to each of said line segments;

analog switch means having data input means for each of said line segments, data output means, and address signal input means, each of said first resistance means being connected between said source and a different one of said data input means, said data output means being connected to said means for generating said control signal; and means for generating address signals, said address signal generating means being connected to said switch means address input means, and being effective to cause said switch means to select and connect one of said data input means to said data output means.

2. The apparatus of claim 1, wherein said address signal generating means comprises a shift register and encoding means, said register driving said encoding means to generate said address signals.

3. The apparatus of claim 1, wherein said means for storing comprises a sample and hold circuit.

4. The apparatus of claim 1, wherein said means for generating central signals comprises clock means and counter means, said clock means indexing said counter means at a rate in accordance with the output of said first programmable input means, the output of said counter means comprising said control signals.

5. The apparatus of claim 4, further comprising means for generating a timing signal and wherein said clock means comprises a controllable frequency divider, said clock means output being a clock signal having a frequency determined by said timing signal and the output of said first programmable input means.

6. The apparatus of claim 5, wherein said counter means is indexed in accordance with said clock signal.

7. The apparatus of claim 5, wherein said clock means comprises a voltage controlled oscillator, said oscillator comprising a counter, means for indexing said counter at a rate determined by said timing signal, means for generating a ramp signal in accordance with the output of said counter and means for comparing said generated ramp signal with the output of said first programmable input means, said comparing means comprising means for generating a pulse when said ramp signal exceeds the output of said first programmable input means.

8. The apparatus of claim 7, wherein said counter means is reset in response to said pulse.

9. The apparatus of claim 1, wherein said first parameter relates to the duration of the line segment.

10. The apparatus of claim 1, wherein said second parameter relates to an end point of the line segment.

11. The apparatus of claim 10, wherein said end point is the termination point of the line segment.

12. The apparatus of claim 1, wherein said second programmable input means comprises:

a power source;

second variable resistance means corresponding to each of said line segments;

analog switch means having data input means for each line segment, data output means for each line segment and address signal input means, each of said second resistance means being connected between said source and a different one of said data input means, each of said data output means being connected to said means for generating the output signal; and means for generating address signals, said address signal generating means being connected to said switch means address input means and causing said switch means to select and connect said data input means to different ones of said data output means.

13. The apparatus of claim 12, wherein said means for storing comprises a sample and hold circuit.

14. The apparatus of claim 13, wherein said means for generating control signals comprises clock means and counter means, said clock means indexing said counter means at a rate in accordance with the output of said first programmable input means, the output of said counter means comprising said control signals.

15. The apparatus of claim 13, wherein said means for generating an output signal comprises a voltage transition circuit;

said voltage transition circuit comprising first and second analog inputs connected, respectively, to receive the outputs from said second programmable input means and said storage means; and means for generating an analog signal representative of the proportional mixture of said outputs as a function of said control signals.

16. The apparatus of claim 12, wherein said means for generating signals comprises clock means and counter means, said clock means indexing said counter means at a rate in accordance with the output of said first programable input means, the output of said counter means comprising said control signals.

17. The apparatus of claim 12, wherein said first parameter relates to the duration of the line segment.

18. The apparatus of claim 12, wherein said second parameter relates to an end point of the line segment.

19. The apparatus of claim 12, wherein said means for generating an output signal comprises a voltage transition circuit;

said voltage transition circuit comprising first and second analog inputs connected, respectively, to receive the outputs from said second programmable input means and said storage means; and means for generating an analog signal representative of the proportional mixture of said outputs as a function of said control signals.

20. The apparatus of claim 1 wherein said means for generating an output signal comprises a voltage transition circuit;

said voltage transition circuit comprising first and second analog inputs connected, respectively, to receive the outputs from said second programmable input means and said storage means; and means for generating an analog signal representative of the proportional mixture of said outputs as a function of said control signals.

21. Apparatus for generating a signal representative of a function or the like comprising a sequence of line segments, the apparatus comprising:

first programmable input means for defining a first parameter corresponding to each of said line segments;

second programmable input means for generating a reference voltage representative of a second parameter corresponding to each of said line segments;

means connected to said second programmable input means for storing said reference voltages;

means connected to said first programmable input means for generating control signals representative of each of said parameters; and means connected to said second programmable input means, said means for generating said control signals, and said means for storing said reference voltages for generating an output signal comprising portions representative of each of said line segments, each of said portions being generated over a period determined by the control signal corresponding to the line segment which said portion represents and having an initial value determined by the stored reference voltage corresponding to the line segment previous to the line segment which said portion represents, and a final value determined by the reference voltage for the line segment which the portion represents, wherein said second programmable input means comprises:

a power source; 'second variable resistance means corresponding to each of said line segments;

analog switch means having data input means for each line segment, data output means for each line segment, and address signal input means, each of said second resistance means being connected between said source and a different one of said data input means, each of said data output means being connected to said means for generating an output signal; and means for generating address signals, said address signal generating means being connected to said switch means, address input means and causing said switch means to select and connect said data input means to different ones of said data output means.

22. The apparatus of claim 21, wherein said address signal generating means comprises a shift register and encoding means, said register driving said encoding means to generate said address signals.

23. Apparatus for generating a signal representative of a function or the like comprising a sequence of line segments, the apparatus comprising:

first programmable input means for defining a first parameter corresponding to each of said line segments;

second programmable input means for generating a reference voltage representative of a second parameter corresponding to each of said line segments;

means connected to said second programmable input means for storing said reference voltages;

means connected to said first programmable input means for generating control signals representative of each of said first parameters; and means connected to said second programmable input means, said means for generating control signals, and said means for storing said reference voltages for generating an output signal comprising portions representative of each of said line segments, each of said portions being generated over a period determined by the control signal corresponding to the line segment which said portion represents and having an initial value determined by the stored reference voltage corresponding to the line segment previous to the line segment which said portion represents, and a final value determined by the reference voltage for the line segment which the portion represents, said means for generating an output signal comprising a voltage transition circuit;

said voltage transition circuit comprising first and second analog inputs, respectively connected to receive the output from said second programmable input means and said storage means; and means for generating an analog signal representative of a proportional mixture of said outputs as a function of said control signals.

24. The apparatus of claim 23, wherein said means for generating an analog signal comprises analog switch means comprising first and second sets of inputs, operably connected to said first and second analog inputs, respectively, a set of outputs and control inputs, said control inputs being connected to receive said control signals such that said switch means causes selected inputs from said inputs sets to be connected to said outputs in response to said control signals.

25. The apparatus of claim 24, wherein said analog signal generating means further comprises means for summing said switch means outputs to produce an analog output signal.

26. The apparatus of claim 25, wherein said summing means comprises a resistance ladder.

27. The apparatus of claim 25, further comprising output means connected to receive and temporarily store the output of said analog signal generating means.

* * * * *